US007275698B2

(12) United States Patent
O'Neill

(10) Patent No.: US 7,275,698 B2
(45) Date of Patent: Oct. 2, 2007

(54) APPARATUS AND METHOD FOR INSTALLING A HEATING SYSTEM IN A BUILDING

(76) Inventor: Timothy O'Neill, 6915 Rt. 55, P.O. Box 599, Wingdale, NY (US) 12594

( * ) Notice: Subject to any disclaimer, the term of this patent is extended or adjusted under 35 U.S.C. 154(b) by 198 days.

(21) Appl. No.: 11/248,134

(22) Filed: Oct. 12, 2005

(65) Prior Publication Data

US 2006/0283966 A1 Dec. 21, 2006

Related U.S. Application Data

(60) Provisional application No. 60/687,419, filed on Jun. 3, 2005.

(51) Int. Cl.
*F24D 5/10* (2006.01)

(52) U.S. Cl. ..... 237/69; 165/49

(58) Field of Classification Search ..... 454/185; 165/49, 56, 171; 237/69, 43
See application file for complete search history.

(56) References Cited

U.S. PATENT DOCUMENTS

| | | | | |
|---|---|---|---|---|
| 2,240,951 | A * | 5/1941 | Hamjy | 237/1 R |
| 2,878,651 | A * | 3/1959 | Heinzelman | 62/235 |
| 3,771,273 | A * | 11/1973 | Brodie | 52/646 |
| 4,458,745 | A * | 7/1984 | Gartner | 165/57 |
| 4,880,051 | A * | 11/1989 | Ohashi | 165/45 |
| 6,533,186 | B2 * | 3/2003 | Neve et al. | 237/69 |
| 7,222,801 | B2 * | 5/2007 | Meirana et al. | 237/69 |

* cited by examiner

*Primary Examiner*—Derek S. Boles
(74) *Attorney, Agent, or Firm*—Milde & Hoffberg, LLP

(57) ABSTRACT

A kit of component parts, and a method for using this kit, are disclosed for installing a boiler for a heating system in a building. The kit comprises prefabricated inlet and outlet manifolds for multiple heating circuits and parts to construct a framework, attachable to the boiler, for holding the manifolds and other parts of the boiler and heating system.

9 Claims, 10 Drawing Sheets

APPARATUS AND METHOD FOR INSTALLING A HEATING SYSTEM IN A BUILDING

CROSS REFERENCE TO RELATED APPLICATION

This application claims priority from U.S. Provisional Patent Application No. 60/687,419, filed Jun. 3, 2005.

BACKGROUND OF THE INVENTION

The present invention relates to an installation kit for a heating system, and a method for installing a heating system, in a building. More particularly, the invention relates to apparatus and a method for installing an oil or gas-fired hydronic boiler for a heating system. Such a boiler uses hot water or steam for heating a building, usually through a plurality of separate heating circuits in the building that create separately controllable heating zones.

The term "boiler" denotes a heating device, usually made of cast iron or steel, for transferring heat from an oil or gas flame (a "burner") to a fluid heat transfer medium contained in the unit. Conventionally, a boiler heats water or an aqueous solution to produce steam or hot water for circulation throughout the building. Various well known commercial manufacturers produce boilers in various sizes and styles for heating residential and commercial buildings.

Boilers are normally sold as stand-alone units with a single return inlet port and a single feed outlet port for the water or aqueous solution.

In the case of a steam heating system, the steam pressure is sufficient to circulate the water through the radiators, baseboard heaters, radiant heating pipes, etc., within the building. In the case of a hot water heating system, the boiler normally includes a water circulator pump which pumps the water through the boiler and presents it at the outlet port or feed after it has been heated in the boiler.

It is conventional to provide several separate heating circuits throughout a building which may be separately controlled to produce either balanced heat in the building or, if desired, separate heating zones with different temperatures. For example, in a residential building, it may be desired to maintain certain portions of the residence at a reduced temperature to save energy while heating the occupied portions of the building at a more comfortable level.

When installing a heating system with multiple heating circuits in a building it is necessary to provide an inlet (return) manifold adjacent the boiler which receives the heating fluid medium (water) from each of the separate heating circuits and supplies the combined output of the heating circuits to the single inlet port of the boiler. Similarly, it is necessary to provide an outlet manifold, connected to the single outlet port (feed) of the boiler, which has a plurality of outlet pipes for presenting the heating fluid medium to each of the separate heating circuits of the building. Thermostatically controlled valves or pumps are provided at each outlet pipe to adjust the volume of the fluid medium passed through each circuit.

When installing a boiler on the floor of a building (usually the basement), the plumbing/heating professional normally brings the boiler unit as well as various pipes and other plumbing and electrical supplies to the building site. The boiler is first unloaded and placed in position for installation. Thereafter, the piping between the boiler and the previously installed heating circuits is constructed by cutting, connecting and soldering various pipes including those of the inlet manifold and outlet manifold. This installation procedure is a very time-consuming task, especially since the inlet and outlet manifolds must be separately constructed and attached in some way either to the boiler itself or to an adjacent wall.

SUMMARY OF THE INVENTION

It is a principal object of the present invention to provide an installation kit for use in installing a boiler on the floor of a building for connection to a plurality of heating circuits within the building.

It is a further object of the present invention to provide a method of installing a boiler in a building using components from the aforementioned installation kit, which substantially reduces the complexity of the installation and the time required to complete the installation.

These objects, as well as other objects which will become apparent from the discussion that follows, are achieved, in accordance with the present invention, by providing an installation kit, and a method for using this kit, which comprises the following components:

(a) A prefabricated inlet manifold having (1) a plurality of inlet pipes for receipt of the fluid medium from a plurality of heating circuits in the building, and (2) a single outlet pipe for connection to the inlet port of the boiler.

(b) A prefabricated outlet manifold having (1) a plurality of outlet pipes for presenting the fluid medium to the separate heating circuits, and (2) a single inlet pipe for connection to said outlet port of the boiler.

(c) Two vertical pipe braces adapted for vertical arrangement to support the inlet and outlet manifolds in an elevated position above the building floor. Each pipe brace includes (1) a lower pipe and (2) an upper pipe for arrangement on a common vertical axis, (3) a lower pipe connector connecting an upper end of the lower pipe to a lower end of the upper pipe together, and (4) an upper pipe connector connected to an upper end of the upper pipe. The lower and upper pipe connectors each have a plurality of pipe stubs including first and second axially aligned pipe stubs for insertion of the lower and upper pipes, respectively, and third and fourth pipe stubs extending perpendicular to these first and second pipe stubs and at a 90° angle with respect to each other.

(d) Two long horizontal pipe braces of equal length and adapted for connecting the two vertical pipe braces together via the lower pipe connectors and the upper pipe connectors, respectively. These horizontal pipe braces are adapted for insertion into the third pipe stubs of the respective pipe connectors.

(e) Four short horizontal pipe braces, each adapted for insertion into one of the horizontally extending fourth pipe stubs for support of one of the manifolds. The short horizontal pipe braces are used in pairs, with one pair for each manifold.

(f) Four pipe clevises, each adapted to hold one of said manifolds to one of the four horizontal pipe braces.

Advantageously, an instruction manual is also included for explaining how the various components of the kit are to be used for installing the boiler.

For further ease of installation, and to avoid the necessity of having to make these parts on-site, the kit also preferably includes a feed riser pipe adapted for connecting the outlet port of the boiler to the inlet pipe of the outlet manifold and a return pipe adapted for connecting the outlet pipe of the inlet manifold to the inlet port of the boiler.

For ease of installation of the framework, the vertical pipe braces may each include a flange at the lower end of each lower pipe for providing footing on the floor, and conduit clamps, each adapted to attach one of the vertical pipe braces to the boiler for structural rigidity.

The method of installing a heating system boiler on a building floor, according to the present invention, using the components of the installation kit described above, includes the following steps:

(a) connecting the two vertical pipe braces together by inserting the two long horizontal braces into the third pipe stubs of the lower and upper pipe connectors, respectively, to form a partial framework;

(b) attaching the four short horizontal pipe braces to respective ones of the fourth stubs of the pipe connectors;

(c) attaching the inlet manifold to one pair of the short horizontal pipe braces at a first elevation, using one of the pipe devises for each pipe brace;

(d) attaching the outlet manifold to another pair of the short horizontal pipe braces at a second elevation, using one of the pipe devises for each pipe brace;

(e) connecting the single outlet pipe of the inlet manifold to the inlet port of the boiler;

(f) connecting the single inlet pipe of the outlet manifold to the outlet port of the boiler; and (g) connecting the heating circuits of the building to the inlet pipes of the inlet manifold and the outlet pipes of the outlet manifold, respectively.

In a variation of the method described above, the order of the steps (b), (c) and (d) may be changed slightly by connecting the manifold first to the four short horizontal pipe braces. These three steps would then be as follows:

(b) attaching each of the inlet and outlet manifolds to two of the four short horizontal pipe braces using one of the pipe devises at each pipe brace;

(c) inserting the two short horizontal pipe braces which hold the inlet manifold into respective ones of the fourth stubs at a first elevation; and (d) inserting said two short horizontal pipe braces which hold the outlet manifold into respective ones of the fourth stubs at a second elevation.

Although the design and construction of the inlet and outlet manifolds may be different for different makes and models of boilers, the number of commonly installed boilers is not so large that the manifolds cannot be prefabricated in advance and maintained in inventory until needed for a typical installation which has two, three or four heating circuits. Similarly, the various pipe braces and connectors provide a flexible "erector set" of parts that enable the professional to create a framework that fits the particular boiler being installed.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
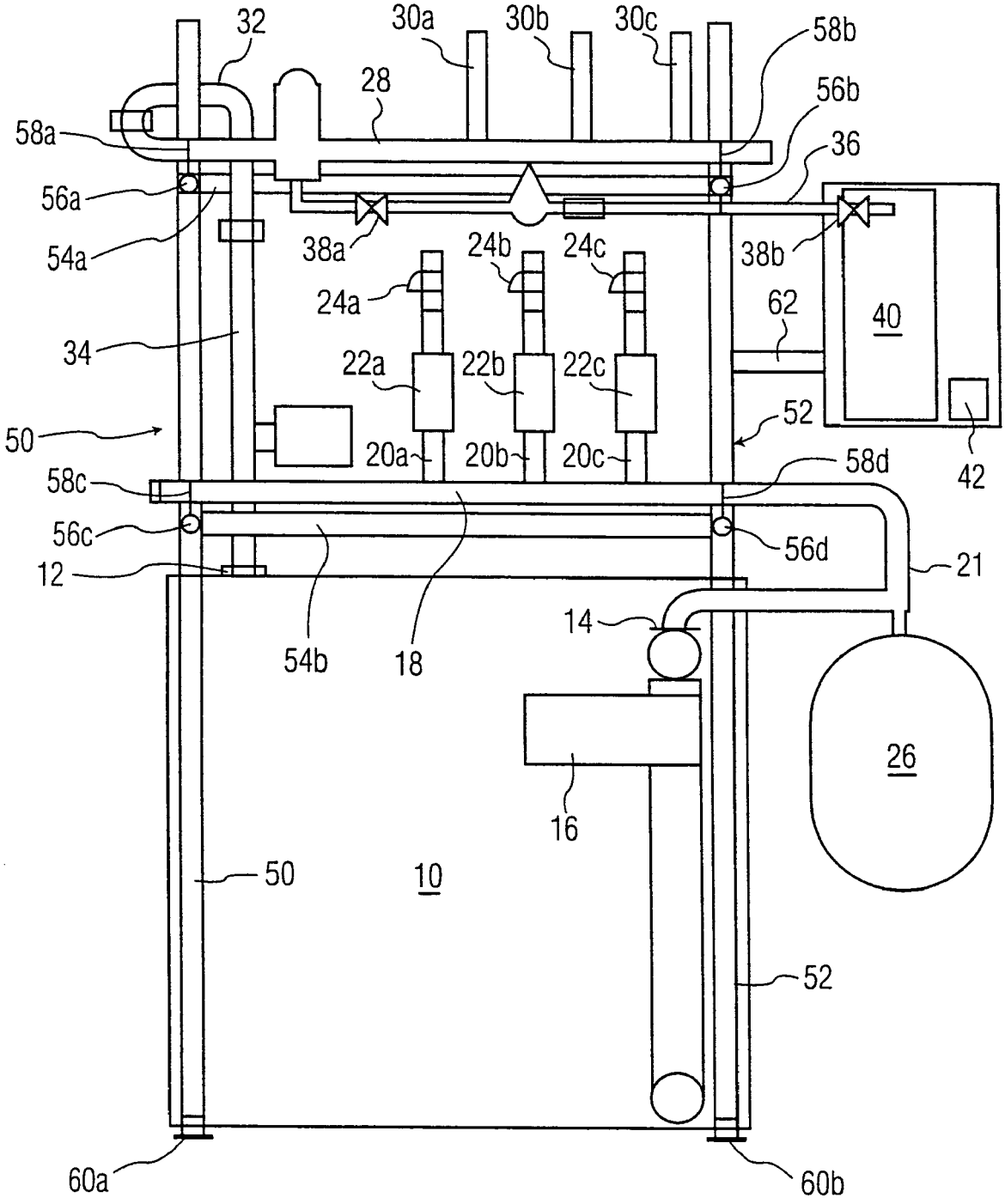
FIG. 1 is a front elevational view showing a boiler that has been installed with the apparatus and method according to the invention.

The preferred embodiments of the present invention will now be described with reference to FIGS. 1-5 of the drawings. Identical elements in the various figures are designated with the same reference numerals.

FIG. 1 shows a boiler unit, which has been installed with the apparatus and method of the present invention. In this case, the boiler is of a type manufactured by Burnham Hydronics in Lancaster, Pa. 17604; however, the present invention may be applied to a boiler of any make or model.

As shown in FIG. 1, the boiler 10 has an outlet or feed port 12 which supplies hot water for three separate heating circuits in the building and an inlet or return port 14 which incorporates a circulator pump 16. Water for the boiler is received via an inlet or return manifold 18 having three inlet pipes 20*a*, 20*b* and 20*c* and an outlet pipe 21 connected to the inlet port 14. The pipes 20 are connected through thermostatically controlled valves 22*a*, 22*b* and 22*c* and manual shut-off valves 24*a*, 24*b* and 24*c*, respectively, to receive water from each of the three separate heating circuits. The water supplied to the inlet port 14 is also applied to a water expansion tank 26.

After passing through the boiler 10, the heated water is directed to an outlet manifold 28, and from there distributed via outlet pipes 30*a*, 30*b* and 30*c* to the individual heating circuits. The outlet manifold receives water from the outlet port 12 of the boiler through a supply pipe 32 and a feed riser pipe 34.

Fresh water is supplied to the boiler, as needed, through a supply pipe 36 having manual shut-off valves 38*a* and 38*b*.

The boiler 10 and the circulation pump 16 are controlled by an electronic control box 40 and a manually actuated, emergency shut-off switch 42.

According to the invention, the inlet and outlet manifolds 18 and 28, respectively, as well as the electronic control unit 40 and shut-off switch 42 are mounted on a framework comprised of two vertical pipe braces 50 and 52, and two long horizontal pipe braces 54*a* and 54*b* that connect the vertical braces together. The framework also includes four short horizontal pipe braces 56*a*, 56*b*, 56*c* and 56*d* and four pipe devises 58*a*, 58*b*, 58*c* and 58*d* which connect the inlet and outlet manifolds 28, 18 to the vertical braces.

The two vertical braces 50 and 52 each have a flange 60*a* and 60*b*, respectively, to provide footing on the floor of the building.

A separate, horizontal pipe brace 62 is also connected to the vertical braces to hold a plywood support 64 for the control unit 40 and emergency shut-off switch 42.

When installing a boiler according to the conventional method, a plumbing/heating professional normally brings to the job site the boiler and the various separate pipes and other plumbing and electrical supplies that are needed. At the site, the boiler is placed in position and then all of the piping shown in FIG. 1 is separately cut and connected together. In particular, the inlet and outlet manifolds for the boiler are separately fabricated and connected to the boiler. Since there is normally no support for these manifolds, unless the wall adjacent the boiler is used, installation of these manifolds usually requires two persons: one to hold the manifold and the other to connect it to the boiler.

According to the present invention, the manifolds are prefabricated and brought to the site together with the boiler. During installation, the framework is first constructed and the manifolds are supported on this framework, prior to connecting them to the inlet and outlet ports of the boiler. This saves considerable time during installation, reduces the number of personnel needed at the job site and requires less expertise than does the conventional method of boiler installation.

Figure 2:
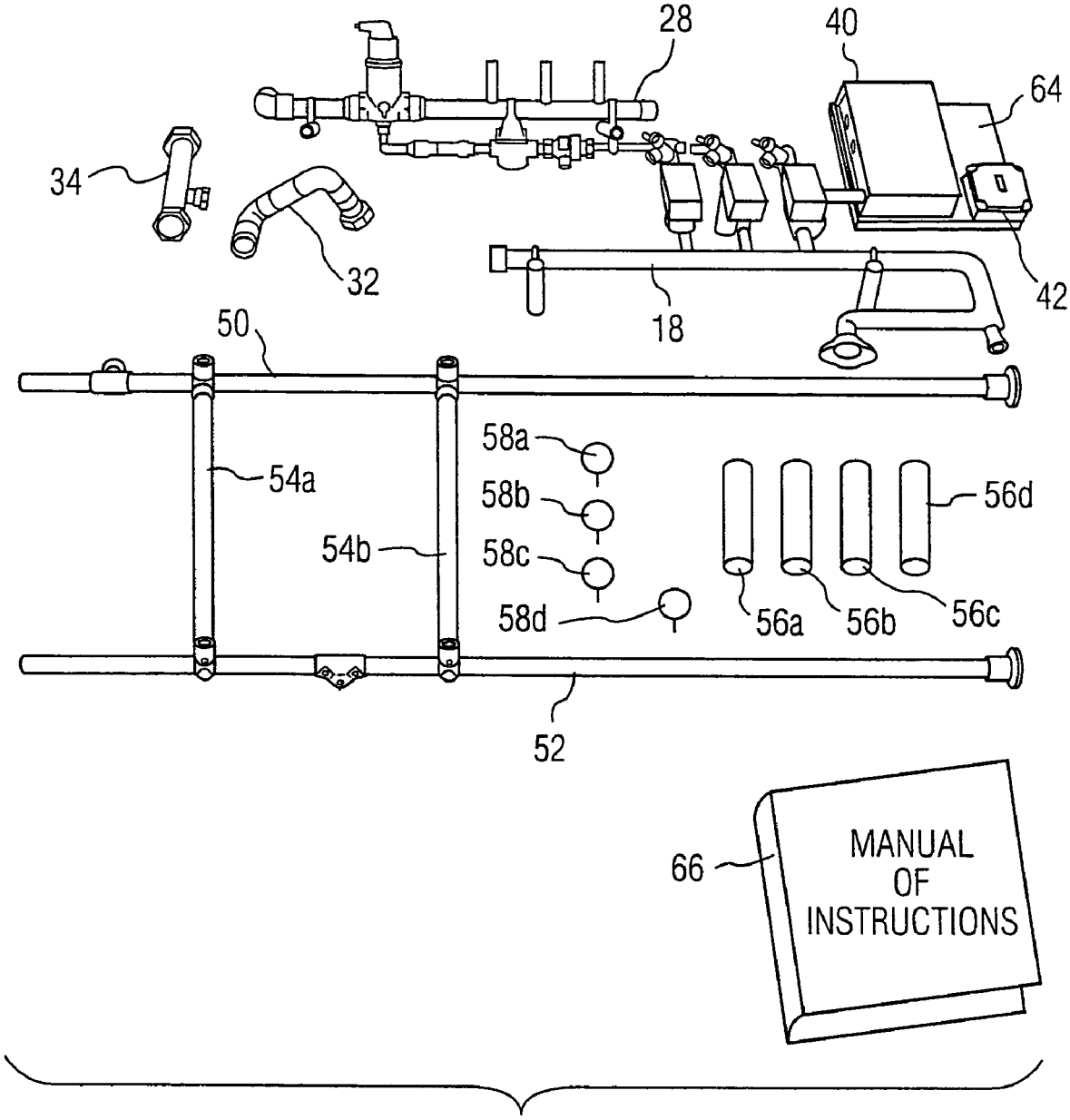
FIG. 2 is a view of the installation kit according to the invention, showing the individual component parts of the kit.

FIG. 2 demonstrates the components of the heating system installation kit according to the present invention. These components include a completely prefabricated inlet manifold 18; a prefabricated outlet manifold 28; a control panel 64 having mounted thereon the electronic control 40 and emergency shut-off switch 42; and a prefabricated supply pipe 32 and feed riser pipe 34, all specifically designed for the boiler to be installed.

The kit further includes parts necessary to construct the framework on site for supporting the inlet and outlet manifolds 18, 28 and the control panel 64. These parts include two vertical pipe braces 50 and 52 incorporating at least two pipe connectors each for connecting pipe components to these vertical braces; and two long horizontal pipe braces 54*a* and 54*b* and four short horizontal pipe braces 56*a*, 56*b*, 56*c* and 56*d* as described above.

Finally, the kit also includes four pipe clevises 58*a*, 58*b*, 58*c* and 58*d* for attaching the manifolds 18, 28 to the short pipe braces 56.

Advantageously, an instruction manual 66 is also provided which illustrates and describes the method of installation.

Figure 3D:
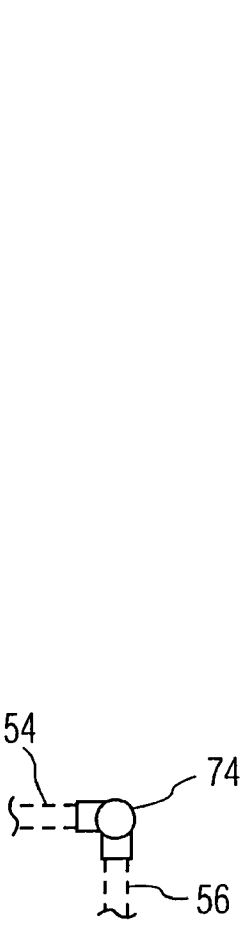
FIGS. 3A, 3B, 3C and 3D are views of a framework constructed with the installation kit according to the invention, showing the front, right side, left side and top of the framework, respectively.
Figure 3C:
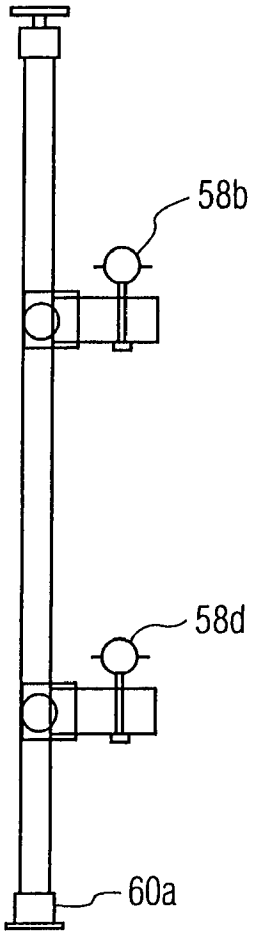
Figure 3B:
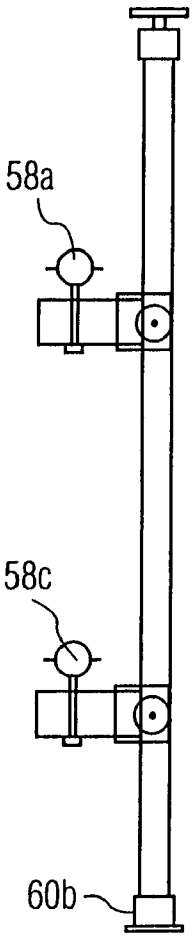
Figure 3A:
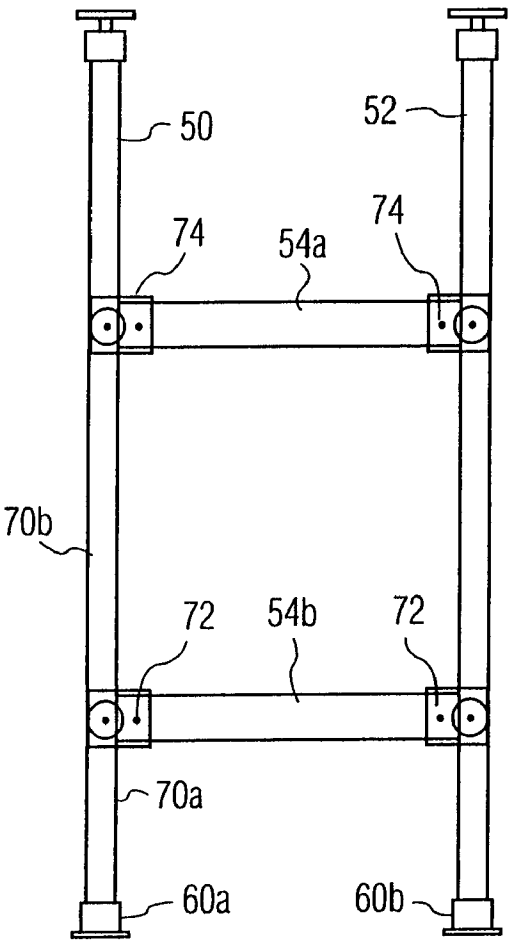

FIGS. 3A, 3B and 3C show, in front, right side and left side views, respectively, how the framework is constructed. The two vertical pipe braces 50 and 52 each include a lower pipe 70*a* and an upper pipe 70*b* arranged on a common vertical axis. The upper end of the lower pipe 70*a* and the lower end of the upper pipe 70*b* are connected together by a lower pipe connector 72. An upper pipe connector 74 is also connected to an upper end of the upper pipe 70*b*. Both the lower and upper pipe connectors 72 and 74 each comprise a plurality of pipe stubs, including first and second axially aligned pipe stubs for insertion of the lower and upper pipes, respectively, and third and fourth pipe stubs extending perpendicular to the first and second pipe stubs and extending at a ninety degree angle with respect to each other as shown in FIG. 3D.

The four short horizontal pipe braces 56*a*, 56*b*, 56*c* and 56*d* are connectible to the lower and upper pipe connectors 72 and 74, serving in pairs to hold either an inlet manifold or outlet manifold by means of the pipe clevises 58*a*, 58*b*, 58*c* and 58*d*.

The framework may also include various other parts as may be convenient for a particular boiler installation. For example, the framework may include a further pipe connector and pipe 62, as shown in FIG. 1, for holding the electronic control unit 40.

Figure 4A:
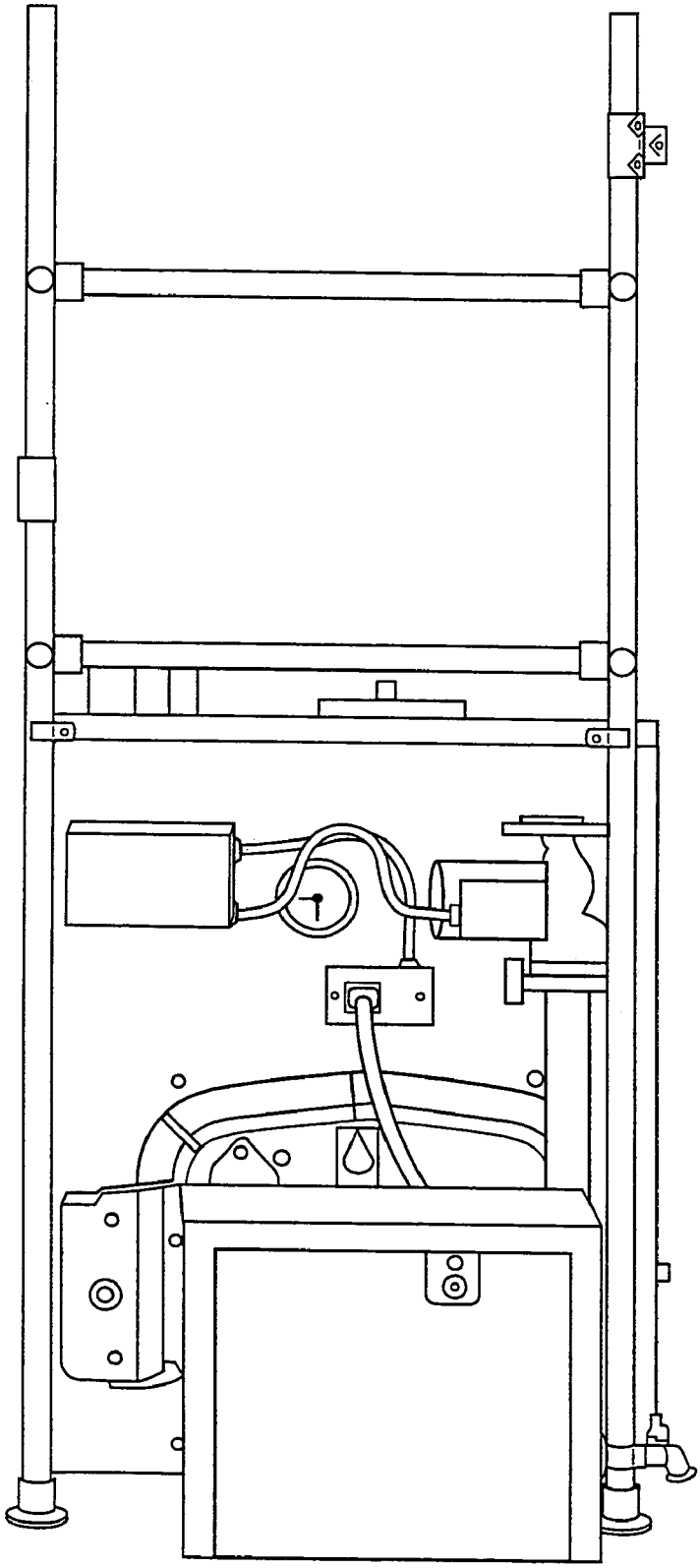
FIGS. 4A, 4B, 4C, 4D and 4E are elevational views showing steps of the installation method according to the invention.
Figure 4B:
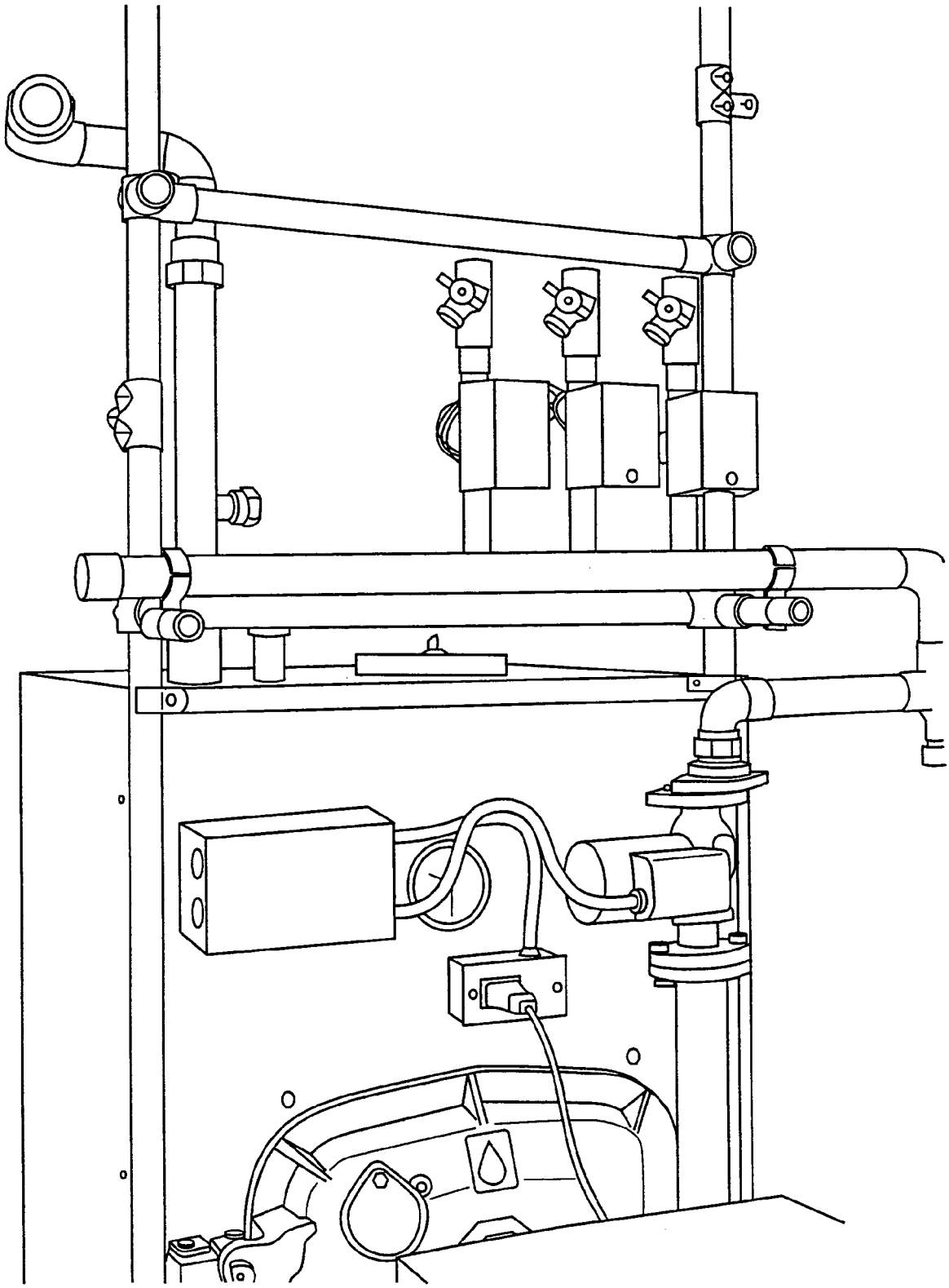

The steps of the method for installing a boiler using the installation kit described above are illustrated in FIG. 4. When arriving at the job site, the first step is to unload the boiler and place it in position on the floor of the building. Thereafter, the framework is erected and, if desired, attached to the boiler. This is accomplished by connecting the two vertical pipe braces together by inserting the two long horizontal braces into the stubs of the lower and upper pipe connectors, as shown in FIG. 4A.

From this point, the installer may proceed in one of two ways: The four short horizontal pipe braces 58*a* . . . 58*d* may first be inserted in the four horizontally protruding pipe stubs of the pipe connectors 72 and 74, followed by mounting and affixing the inlet and outlet manifolds thereto by means of the pipe clevises 58*a* . . . 58*d*. Alternatively, pairs of the two short horizontal pipe braces may be attached to the inlet and outlet manifolds, respectively by means of the pipe clevises 58. Thereafter, these pairs of short horizontal pipe braces are inserted into the stubs of the connectors 72 and 74, as shown for the inlet manifold in FIG. 4B.

Figure 4C:
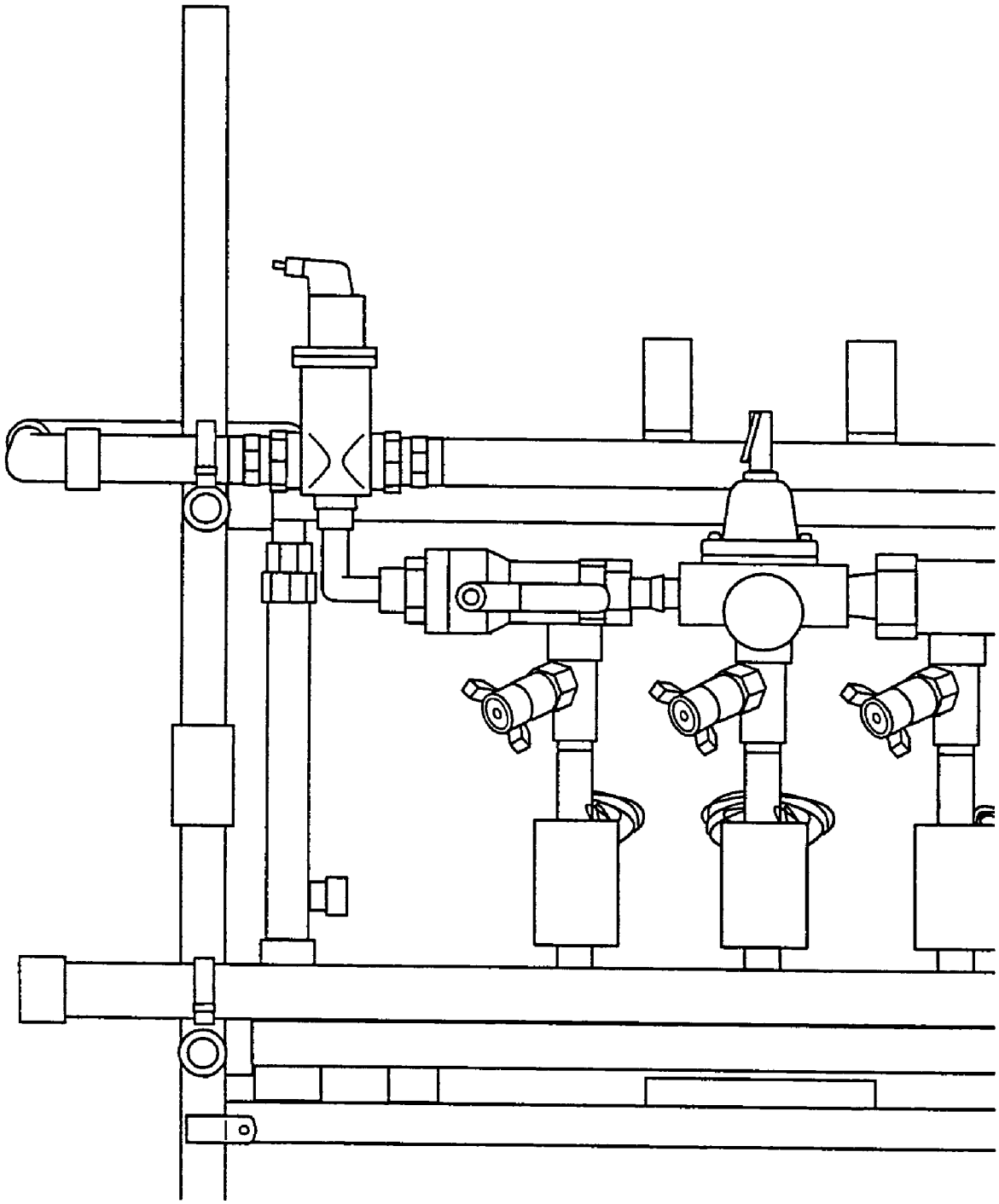

Next, the single outlet pipe 21 of the inlet manifold 18 (return) is connected to the inlet port of the boiler, and the prefabricated supply and feed riser pipes 31 and 34 supplied with the installation kit are connected from the boiler outlet port to the inlet of the outlet manifold 28, as shown in FIG. 4C.

Figure 4D:
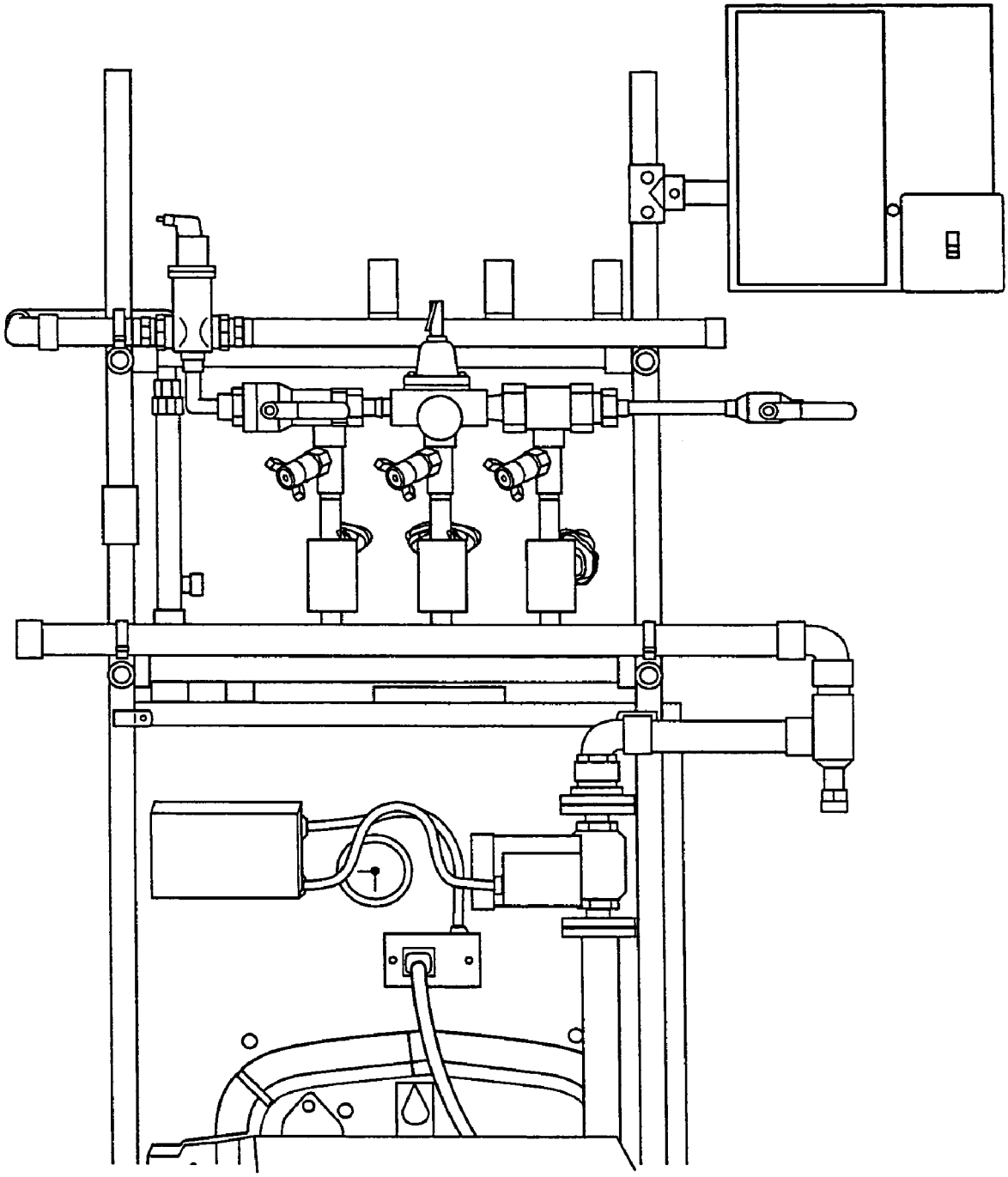

Thereafter, if desired, the control panel 64 with the electronic control unit 40 and emergency switch 42 may be connected to the framework via a separate short pipe brace 62 as shown in FIG. 4D.

Figure 4E:
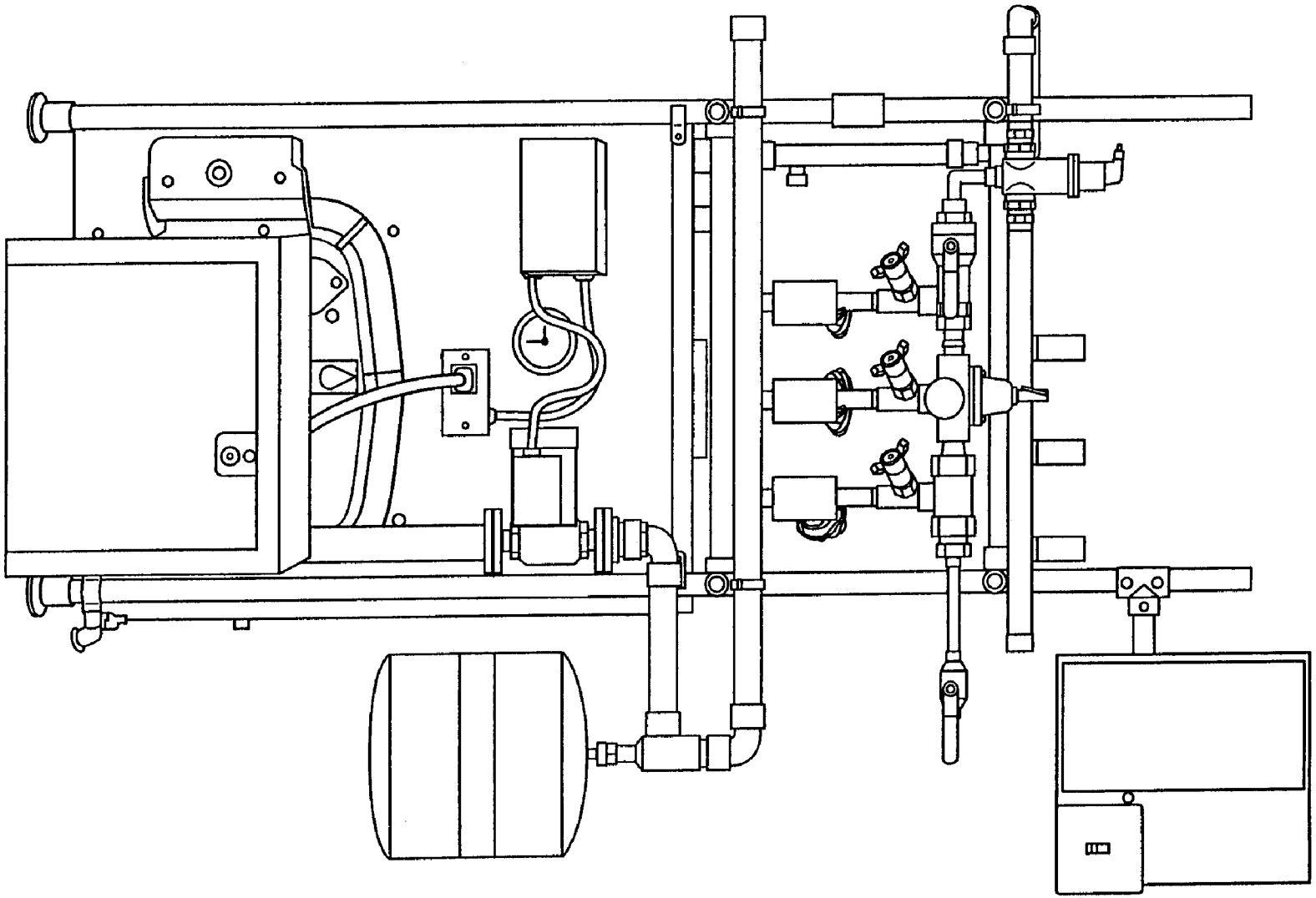

Finally, each of the heating circuits in the building is connected to an inlet pipe of the inlet manifold (return) and an outlet pipe of the outlet manifold (feed), respectively. Also, as shown in FIG. 4E, the expansion tank is connected to the pipe 21 connecting the outlet pipe of the inlet manifold to the inlet 14 of the boiler.

Both the installation kit and the method of installation may be varied to suit each particular boiler and boiler installation. FIG. 5 illustrates the use of a modified installation kit that provides a framework for supporting the boiler itself above the floor of the building.

Figure 5A:
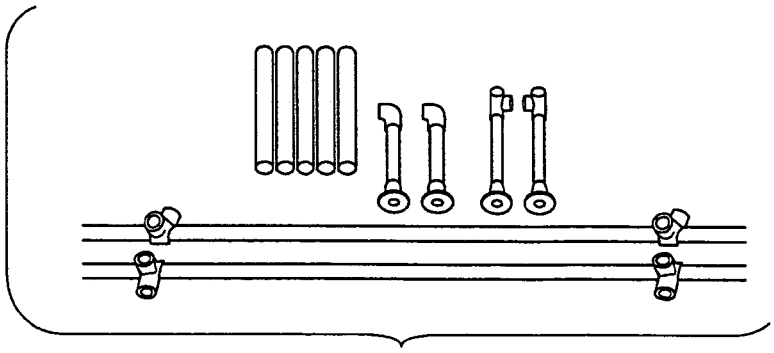
FIGS. 5A, 5B, 5C, 5D and 5E are elevational views showing steps of the installation method according to the invention, with a modification from the method of FIG. 4.
Figure 5B:
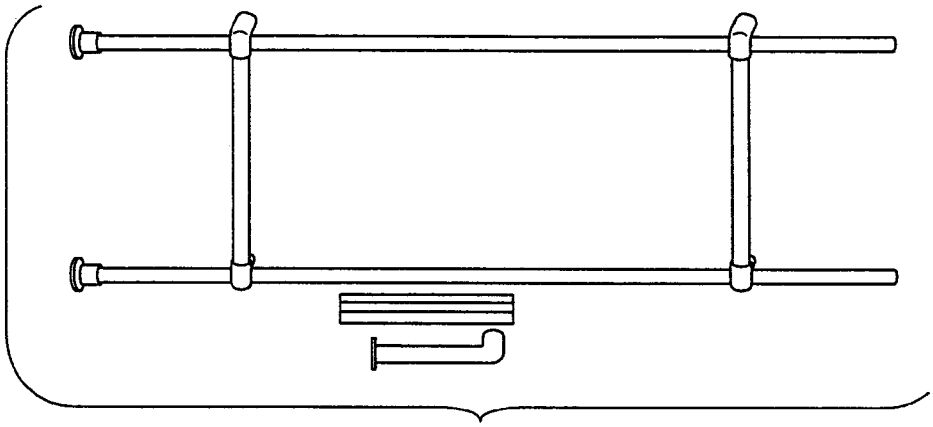
Figure 5C:
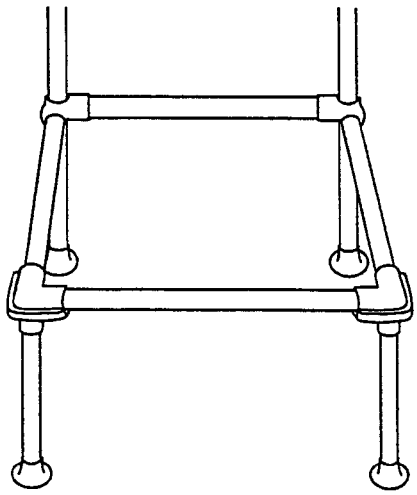
Figure 5D:
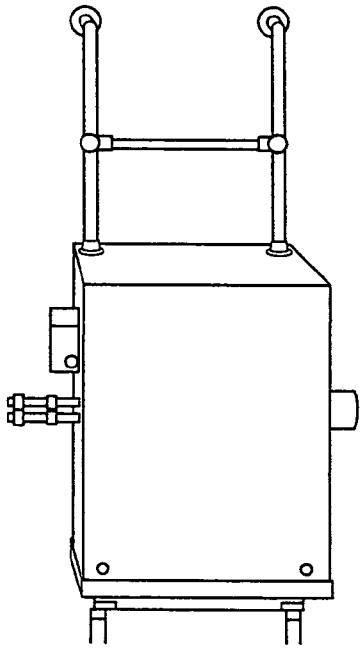
Figure 5E:
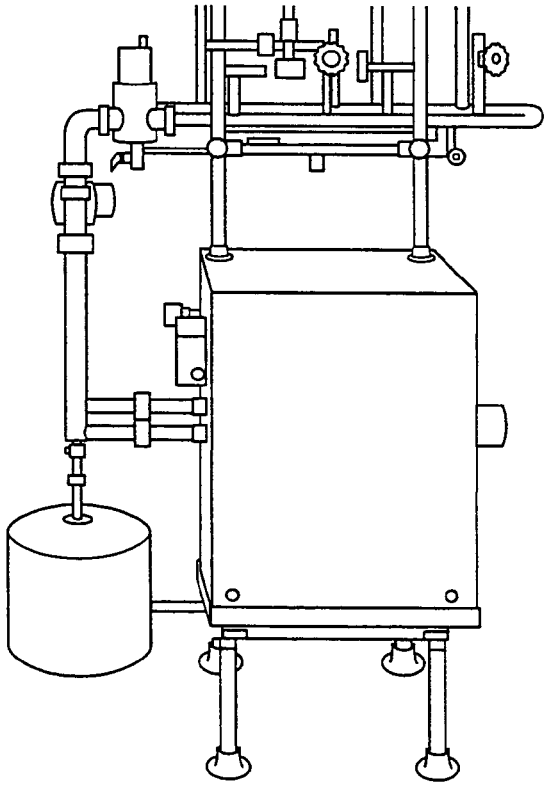

As shown in FIGS. 5A and 5B, the kit includes two additional vertical pipe braces and three additional horizontal pipe braces to form a "seat" upon which the boiler may rest (FIG. 5C). In this embodiment, the framework is first erected at the boiler site and attached to a wall. Thereafter, the boiler is placed upon, and preferably affixed to, the framework as shown in FIG. 5D.

The framework is then used to mount the inlet and outlet manifolds (FIG. 5D) in the manner described above in connection with FIG. 4.

There has thus been shown and described a novel apparatus and method for installing a heating system in a building which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An installation kit for use in installing a heating system for a building, said heating system comprising a plurality of heating circuits throughout the building for distributing heat from a fluid medium in a plurality of building zones, and a boiler arranged on a floor of the building for heating the fluid medium, said boiler having an inlet port and an outlet port for said fluid medium, said kit comprising, in combination:

(a) an inlet manifold having a plurality of inlet pipes for receipt of the fluid medium from said plurality of heating circuits in the building and a single outlet pipe for connection to said inlet port of the boiler;

(b) an outlet manifold having a plurality of outlet pipes for presenting the fluid medium to said plurality of heating circuits and a single inlet pipe for connection to said outlet port of the boiler;

(c) two vertical pipe braces adapted for vertical arrangement to support said manifolds in an elevated position above the building floor, each first pipe brace including a lower pipe and an upper pipe for arrangement on a common vertical axis, a lower pipe connector connecting an upper end of said lower pipe to a lower end of said upper pipe together and an upper pipe connector connected to an upper end of said upper pipe, said lower and upper pipe connectors each comprising a plurality of pipe stubs including first and second axially aligned pipe stubs for insertion of said lower and upper pipes, respectively, and third and fourth pipe stubs extending perpendicular to said first and second pipe stubs and extending at a 90° angle with respect to each other;

(d) two long horizontal pipe braces of equal length and adapted for connecting said two vertical pipe braces together via said lower pipe connectors and said upper pipe connectors, respectively, said horizontal pipe braces being adapted for insertion into said third pipe stubs of said respective pipe connectors;

(e) four short horizontal pipe braces, each adapted for insertion into one of said fourth pipe stubs for support of one of said manifolds;

(f) four pipe clevises, each adapted to hold one of said manifolds to one of said four horizontal pipe braces;

wherein the pipe braces may be connected together on site of the heating system installation to provide a framework for attachment and support of said inlet and outlet manifolds, as well as further components of the heating system.

2. The installation kit recited in claim 1, further comprising a feed riser pipe adapted for connecting the feed pipe of the inlet manifold to the outlet port of the boiler.

3. The installation kit recited in claim 2, further comprising a return pipe adapted for connecting the return riser pipe to the inlet port of the boiler.

4. The installation kit recited in claim 1, wherein said vertical pipe braces each include a flange at the lower end of the lower pipe thereof, for providing footing on the floor.

5. The installation kit recited in claim 1, further comprising two conduit clamps, each adapted to connect one of said vertical pipe braces to the boiler.

6. The installation kit recited in claim 1, wherein said heating system includes a fluid medium circulator pump operative to present said fluid medium at said inlet port after it has been heated in said boiler.

7. The installation kit recited in claim 1, further comprising an instruction manual for illustrating and describing the method of installation.

8. A method of installing a heating system boiler on a building floor using components from the installation kit recited in claim 1, said boiler having an inlet port and an outlet port for the fluid medium, said method comprising the steps of:

(a) connecting the two vertical pipe braces together by inserting the two long horizontal braces into the third pipe stubs of said lower and upper pipe connectors, respectively, to form a partial framework;

(b) attaching said four short horizontal pipe braces to respective ones of said fourth stubs of said pipe connectors;

(c) attaching said inlet manifold to one pair of said short horizontal pipe braces at a first elevation, using one of said pipe clevises for each pipe brace;

(d) attaching said outlet manifold to another pair of said short horizontal pipe braces at a second elevation, using one of said pipe devises for each pipe brace;

(e) connecting the single outlet pipe of said inlet manifold to said inlet port of the boiler;

(f) connecting the single inlet pipe of said outlet manifold to said outlet port of the boiler; and (g) connecting the heating circuits of the building to the return pipes of the return manifold and the feed pipes of the feed manifold, respectively.

9. A method of installing a heating system boiler on a building floor using components from the installation kit recited in claim 1, said boiler having an inlet port and an outlet port for the fluid medium, said method comprising the steps of:

(a) connecting the two vertical pipe braces together by inserting the two long horizontal braces into the third pipe stubs of said lower and upper pipe connectors, respectively, to form a partial framework;

(b) attaching each of the inlet and outlet manifolds to two of the four short horizontal pipe braces using one of the pipe devises at each pipe brace;

(c) inserting the two short horizontal pipe braces which hold the inlet manifold into respective ones of the fourth stubs at a first elevation;

(d) inserting said two short horizontal pipe braces which hold the outlet manifold into respective ones of the fourth stubs at a second elevation;

(e) connecting the single outlet pipe of said inlet manifold to said inlet port of the boiler;

(f) connecting the single inlet pipe of said outlet manifold to said outlet port of the boiler; and (g) connecting the heating circuits of the building to the inlet pipes of the inlet manifold and the outlet pipes of the outlet manifold, respectively.

* * * * *